US007600568B2

(12) United States Patent
Ross et al.

(10) Patent No.: US 7,600,568 B2
(45) Date of Patent: Oct. 13, 2009

(54) SAFETY VENT VALVE

(75) Inventors: Colby W. Ross, Houston, TX (US); Timothy W. Sampson, Spring, TX (US); William D. Myers, Jr., Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 190 days.

(21) Appl. No.: 11/444,881

(22) Filed: Jun. 1, 2006

(65) Prior Publication Data

US 2007/0277966 A1 Dec. 6, 2007

(51) Int. Cl.
*E21B 43/11* (2006.01)

(52) U.S. Cl. ..... 166/297; 166/55.1

(58) Field of Classification Search ..... 166/297, 166/298, 55.1; 89/1.15; 102/309–310
See application file for complete search history.

(56) References Cited

U.S. PATENT DOCUMENTS

| | | | | | |
|---|---|---|---|---|---|
| 2,328,247 | A * | 8/1943 | Alexander | 175/4.58 |
| 2,331,057 | A * | 10/1943 | Lloyd | 175/4.59 |
| 2,349,666 | A * | 5/1944 | McCullough | 175/4.58 |
| 2,843,041 | A * | 7/1958 | Stewart | 175/3.5 |
| 3,842,919 | A | 10/1974 | Dermott | |
| 4,330,039 | A * | 5/1982 | Vann et al. | 166/297 |
| 4,605,074 | A | 8/1986 | Barfield | |
| 4,790,385 | A | 12/1988 | McClure et al. | |
| 4,949,789 | A * | 8/1990 | Lafitte | 166/298 |
| 5,044,388 | A | 9/1991 | Barton et al. | |
| 5,318,126 | A * | 6/1994 | Edwards et al. | 166/297 |
| 5,366,013 | A * | 11/1994 | Edwards et al. | 166/297 |
| 5,366,014 | A * | 11/1994 | George | 166/297 |
| 5,421,418 | A * | 6/1995 | Nelson et al. | 175/2 |
| 6,095,247 | A | 8/2000 | Streich et al. | |
| 6,289,991 | B1 * | 9/2001 | French | 166/382 |
| 6,588,508 | B2 * | 7/2003 | Parrott et al. | 166/297 |
| 6,732,798 | B2 * | 5/2004 | Johnson et al. | 166/297 |
| 2002/0053434 | A1 * | 5/2002 | Chen et al. | 166/297 |
| 2004/0129415 | A1 * | 7/2004 | Xi et al. | 166/55.1 |
| 2006/0237190 | A1 * | 10/2006 | Snider et al. | 166/250.07 |

FOREIGN PATENT DOCUMENTS

EP 0256178 A1 2/1988

* cited by examiner

*Primary Examiner*—David J Bagnell
*Assistant Examiner*—Cathleen R Hutchins
(74) *Attorney, Agent, or Firm*—Bracewell & Guiliani LLP

(57) ABSTRACT

A perforating system connection sub comprising a vent valve for providing fluid flow communication through the connection sub wall. The vent valve is selectively opened and may include a frangible member. The frangible member is rupterable by the shock wave produced by ignition of an associated detonation cord.

15 Claims, 4 Drawing Sheets

SAFETY VENT VALVE

BACKGROUND OF THE INVENTION

1. Field of the Invention

The invention relates generally to the field of oil and gas production. More specifically, the present invention relates to a safety vent valve. Yet more specifically, the present invention relates to a safety vent valve for a perforating gun system.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

One typical example of a perforating system 4 is shown in FIG. 1. As shown, the perforating system 4 comprises one or more perforating guns 6 strung together to form a perforating gun string 3, these strings of guns can sometimes surpass a thousand feet of perforating length. Connector subs 18 provide connectivity between each adjacent gun 6 of the string 3. Many gun systems, especially those comprised of long strings of individual guns, are conveyed via tubing 5. Others may be deployed suspended on wireline or slickline (not shown).

Included with the perforating gun 6 are shaped charges 8 that typically include a housing, a liner, and a quantity of high explosive inserted between the liner and the housing. When the high explosive is detonated, quickly expanding explosive gases are formed whose force collapses the liner and ejects it from one end of the charge 8 at very high velocity in a pattern called a "jet" 12. The jet 12 perforates the casing and the cement and creates a perforation 10 that extends into the surrounding formation 2. The resulting perforation 10 provides fluid communication between the formation 2 and the inside of the wellbore 1. In an underbalanced situation (where the formation pressure exceeds the wellbore pressure) formation fluids flow from the formation 2 into the wellbore 1, thereby increasing the pressure of the wellbore 1. Moreover, as the explosive gases cool and contract, a large pressure gradient is created between the inside of the perforating gun body 14 and the wellbore 1. This pressure differential in turn draws wellbore fluid within the perforating gun body 14 through gun apertures 16.

FIGS. 2*a* and 2*b* illustrate a portion of a gun string 3 for providing additional detail of the connector sub 18 disposed between the two perforating guns 6. As shown, the connector sub 18 has a protruding member 19 on each of its ends formed to mate with a corresponding recess 21 provided on the end of each perforating gun 6. The guns 6 as shown are secured to the connector sub 18 by a series of threads 23 formed on the inner diameter of the recesses 21 and the outer diameter of the protruding member 19.

Also disposed within the gun string is a detonating cord 20 for providing an initiating/detonating means for the shaped charge 8. Detonation of the shaped charge 8 is accomplished by activating the detonating cord 20 that in turn produces a percussive shockwave for commencing detonation of the shaped charge explosive 8. Typically the shockwave is initiated in the detonating cord 20 at its top end (i.e. closest to the surface 9) and travels downward through the gun string 3. To ensure propagation of the shockwave to each individual gun 6 making up the gun string 3, each connecting sub 18 is also equipped with a section of detonating cord 20. The section of detonating cord 20 in the connecting sub 18 resides in a cavity 22 formed therein. Transfer charges 24 on the end of each segment of the detonating cord 20 continue travel of the shock wave from the end of one gun body 6, to the section of detonating cord 20 in the connecting sub 18, from the connecting sub 18 to the next adjacent gun body 6, and so on. The shock wave transfer function of the transfer charges 24 produces a passage 26 between the gun bodies 6 and the connecting sub 18. As shown in FIG. 2*b*, the shaped charge 8 detonates in response to exposure of the shock wave produced by the detonating cord 20. Detonation of the shaped charge 8 in turn leaves an aperture 16 that provides fluid flow from the wellbore 1 to inside of the gun body 14. Similarly, detonation of the transfer charges 24 in response to the detonating cord shock wave, creates the passage 26 provides a fluid flow conduit between the inside of the perforating gun bodies 6 and the connecting sub cavity 22. Accordingly, the cavity 22 is subject to wellbore pressures subsequent to exposure of the detonating cord shock wave. Often the debris within the wellbore fluid can be carried with the fluid into the cavity 22. When retrieving the gun system 4 from the wellbore 1, the cavities 22 will be vertically oriented that in turn can allow the fluid debris to collect within the passages 26 thereby creating a potential clogging situation that can trap the wellbore fluid within the connecting sub 18. Since the wellbore fluid pressure can often exceed 1000 psi, this trapped pressure can present a personnel hazard during disassembly of the gun string 3. Therefore, an apparatus and method for eliminating the potential for trapped pressure within the connecting sub 18 is needed.

BRIEF SUMMARY OF THE INVENTION

An embodiment of the present invention involves a connecting sub comprising a housing, a pressure producing element within the housing, and a vent valve in operable communication with the pressure producing element, wherein the vent valve is selectively opened in response to activation of the pressure producing element. The connecting sub may further comprise a cavity formed within the housing. When the vent valve is in the opened position it provides fluid communication between the cavity and the outside of the housing. A frangible member may be included within the vent valve. The pressure producing element may comprise a detonating cord. The pressure producing element may include a shock wave producing member, such as a detonating cord, or a combustible material, such as a propellant.

One embodiment of the connecting sub may comprise a first end, a second end, a perforating gun attachable to the first end, a shock wave producing member disposed within the perforating gun, a first transfer charge combinable with the connecting sub shock wave producing member and a second transfer charge combinable with the perforating gun shock wave producing member. A second perforating gun may be included with the connecting sub attachable to the second end, a shock wave producing member disposed within the second perforating gun, a third transfer charge combinable with the connecting sub shock wave producing member and a fourth transfer charge combinable with the second perforating gun shock wave producing member. A retaining ring coupled to the housing and to the vent valve can also be included with the connecting sub.

The connecting sub can further comprise a coupling member coupled to the shock wave producing member. The coupling member can be an opening formed to receive the shock-wave producing member therethrough, a hook shaped member, or opposing elements formed to receive the shock-wave producing member therebetween.

A method of safely venting a downhole tool is included herein. The method includes providing a frangible element on the downhole tool, activating a pressure producing substance, wherein activating the pressure producing substance ruptures the frangible element thereby creating apertures through the wall of the downhole tool to create fluid communication between the inner and outer surfaces of the downhole tool. The pressure producing substance can include a detonating cord, a propellant, as well as combinations thereof. Fluid communication between the inside and outside of the downhole tool.

DETAILED DESCRIPTION OF THE INVENTION

Figure 1:
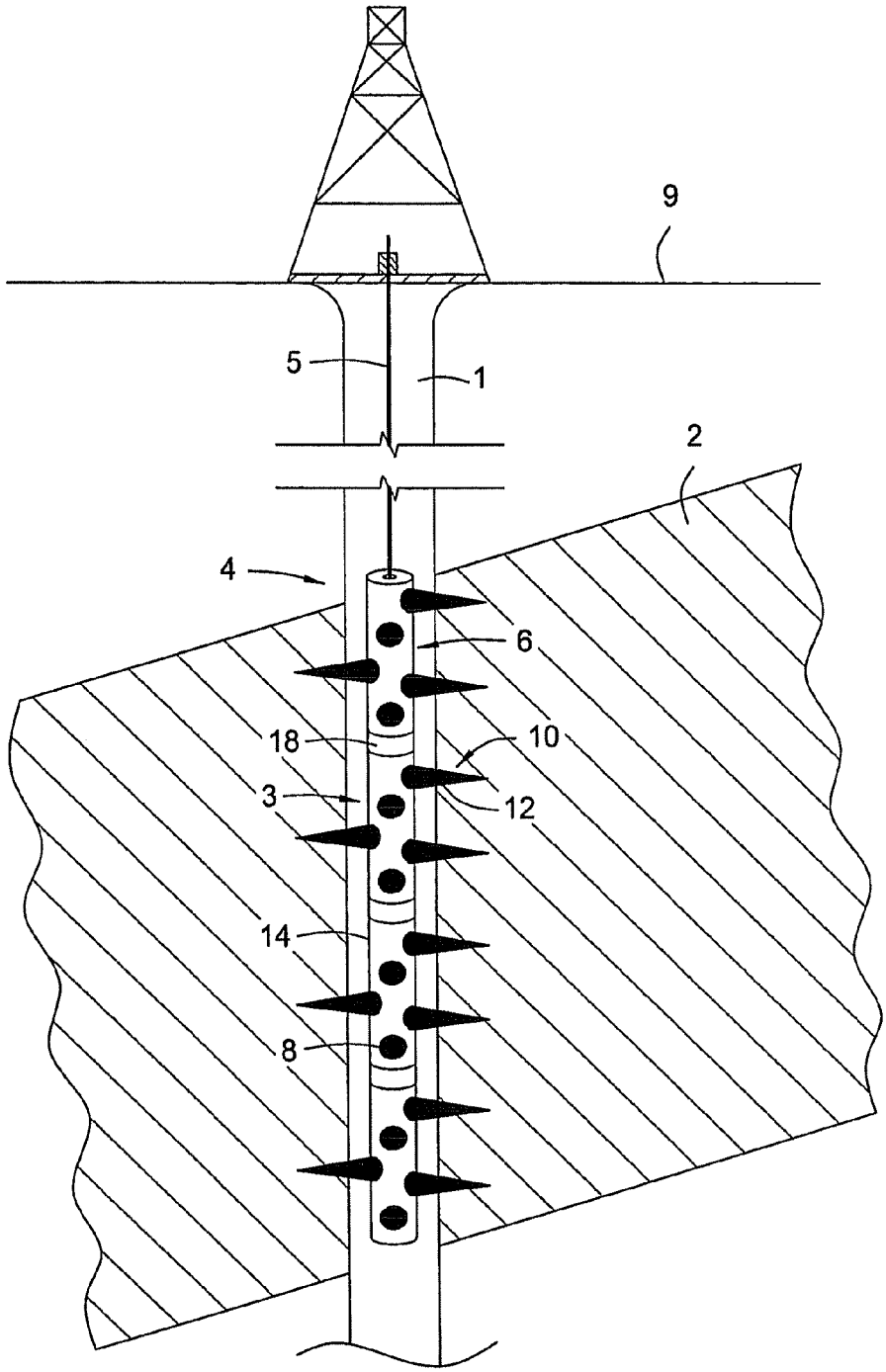
FIG. 1 (PRIOR ART)
FIG. 1 is a partial cutaway side view of a perforating system.
Figure 2A:
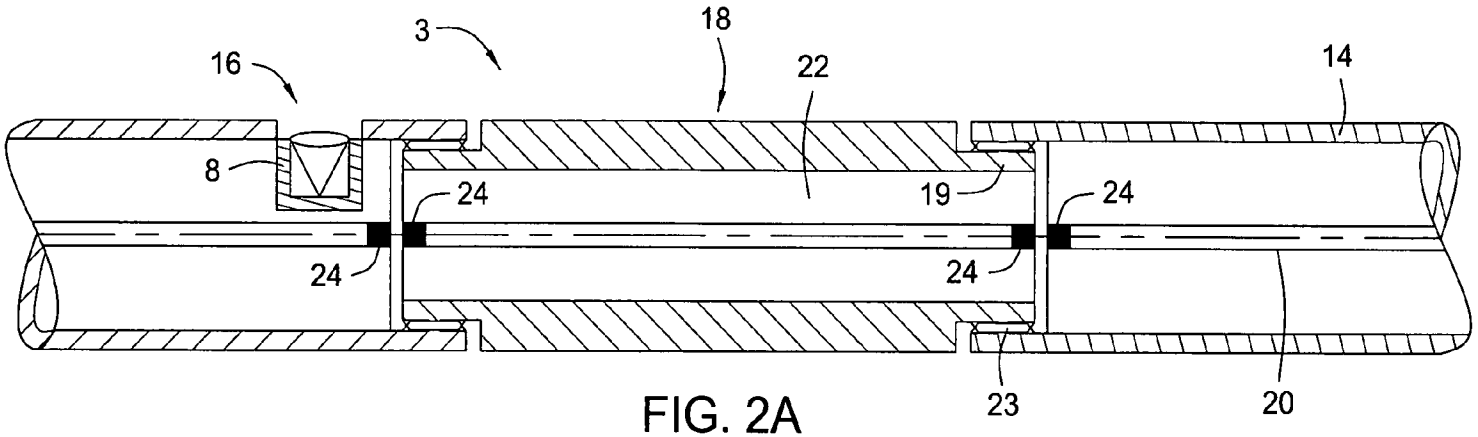
FIG. 2A (PRIOR ART)
FIG. 2*a* illustrates a partial cutaway of a portion of a perforating string.
Figure 2B:
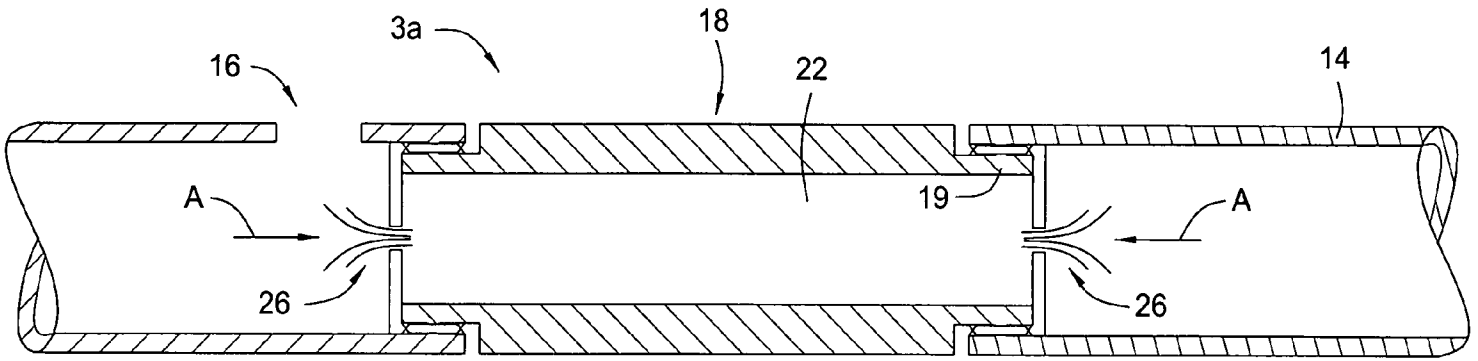
FIG. 2B (PRIOR ART)
FIG. 2*b* depicts a partial cutaway of a portion of a perforating string.
Figure 3:
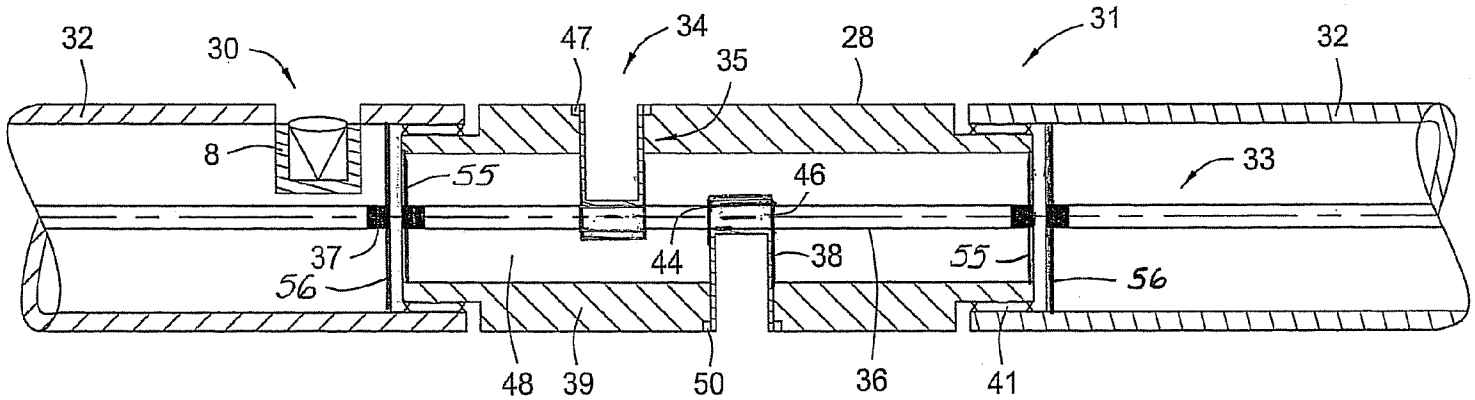
FIG. 3 is a cutaway side view of a segment of a perforating string in accordance with an embodiment of the present disclosure.

The device of the present disclosure comprises a safety vent valve useful for relieving fluid pressure within a downhole tool. With reference now to FIG. 3 one example of a downhole tool with a vent valve is illustrated. More specifically, the embodiment shown is a segment of a perforating string 31 that comprises a connector sub 28 and gun bodies 32, where the gun bodies 32 are disposed on both ends of the connector sub 28, the connector sub 28 is shown without shaped charge explosives. The embodiment of the connector sub 34 of FIG. 3 comprises a housing 39 having a cavity 48 formed therein and configured on both of its ends for coupling with a perforating gun 32. One example of a coupling means comprises threads 41 disposed on the outer surface of the ends of the housing 39 formed to mate with corresponding threads on the inner circumference of the end of the gun bodies 32. A recess 35 is provided within the wall of the connector sub 28 extending from the outer surface of the connector sub 28 into a cavity 48 residing within the body of the cavity 48. While the recess 35 is shown in an orientation substantially perpendicular to the axis of the connector sub 28, it is not limited to this configuration but instead can be formed at any other angle between the outer surface of the connector sub 28 and the cavity 48. In the embodiment of the connector sub 28 of FIG. 3, the cavity 48 is sealed and thus not in fluid communication with either the gun bodies 32 or its outer surface. Bulkheads 55, 56 at the mating edges of both the connector sub 28 and the gun bodies 32 are formed of rigid non-porous material, thereby creating a fluid flow barrier. Additionally, as discussed in more detail below, the presence of a vent valve 34 in the recess 34 prevents fluid flow therethrough when the vent valve 34 is in the closed configuration.

The recess 35 provided in the connector sub 28 is formed to receive the vent valve 34. The vent valve 34 as illustrated comprises a body 38 formed into a generally annular configuration. An embodiment of the vent valve 34 is provided in a cross sectional view in FIG. 4. However the vent valve 34 of the present disclosure is not limited to the embodiment of FIG. 4, but can instead include any suitable cross sections such as rectangular, oval, a multi-sided configuration (hexagonal, octagonal, etc), or any other suitable form. The vent valve 34 shown also includes a membrane 40 disposed within its body 38 that lies in a plane substantially perpendicular to the axis of the vent valve 34. The vent valve 34 can be a uni-body construction machined from a single piece of stock material, or can be comprised of two separate segments joined together proximate to the location of the membrane 40.

Figure 4:
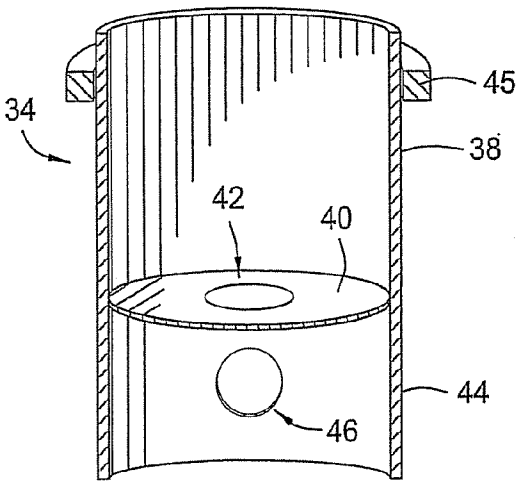
FIG. 4 is a perspective view of a cutaway of a vent valve.

The membrane 40 of the embodiment of FIG. 3 and FIG. 4 fully encompasses the annular region within the body 38 thereby preventing fluid flow through the vent valve 34—when in this configuration. However the membrane 40 is frangible and thus when ruptured, can allow fluid through the vent valve 34. One example of a suitable membrane for use with the present device is a rupture disk. An example of a suitable material for the vent valve 34 and sub is any alloy steel capable of withstanding the expected downhole conditions. Other alternatives include glass, ceramic, aluminum, cast iron, plastics, and articles formed from NYLON®. Proper choice of material is well within the scope of those skilled in the art.

The body 38 further comprises a skirt section 44 extending downward from the membrane 40; optionally included within the skirt 44 is an opening 46 that provides a passageway through the skirt 44. The opening 46 is aligned generally perpendicular to the axis of the housing 38. The opening 46 should have dimensions sufficient to accommodate the detonating cord 36 to pass therethrough. One embodiment of the vent valve 34 may include a shoulder stop 45 formed on the outer circumference of the body 38 in an orientation generally coaxial to the body 38. In the embodiment including the shoulder stop 45, the recess 35 will have an increased diameter proximate to its opening to receive the shoulder stop 45 therein. A ridge 47 formed by a reduction in the recess diameter should be included in cooperation with the shoulder stop 45, proper placement of the shoulder stop 45 in conjunction with the ridge 47 can situate the opening 46 within the cavity 48 for proper placement of the detonating cord 36 therethrough. Once spatially aligned, the vent valve 34 can be rotated (if needed) for alignment with the detonating cord 36.

The vent valve 34 can be retained within the recess 35 with a retaining ring 50. The ring 50 can be disposed within the recess in any number of ways, such as threaded, press fit, snap ring, welded, or any other suitable manner.

It should be pointed out that the vent valve 34 of the present device is not limited to those having a frangible member such as the membrane, but instead can include any device or apparatus responsive to shock waves. One additional example could be that of a sliding manifold having strategically placed ports such that the member when pushed upward in response to a shock wave, the ports could be situated to allow fluid communication from the cavity 48 of the connector sub 28 to the outer surroundings of the connector sub 28. Another alternative embodiment includes a spring-loaded relief valve that is responsive to a pressure differential between the cavity and ambient conditions, and opens when the cavity pressure exceeds ambient pressure by some set amount. The spring loading could then reseat the valve for repeated uses and or repeated pressure loadings.

A portion of a detonating system 33 is shown within the connector sub 28 and gun bodies 32. The portion of the detonating system 33 shown comprises, detonating cords 36 and transfer charges 37 and extends through the gun bodies 32 as well as into the connector sub 28. As previously discussed, initiation of detonation systems typically occurs on the section of the detonating system closest to the surface 9. Initiation of the detonating system 33 produces a shock wave within the detonating cord 36 that propagates downward through the detonating system 33 (and cord 36). Moreover, the shockwave is transferred between successive segments of the gun string (i.e. adjacent gun bodies 32 and the connector sub 28) by virtue of the transfer charges 37 provided at the terminating point of each end of the detonating cord 36 within segment. The detonating cord 36 can be of any shape (i.e. round, flat, smaller, larger diameter, and varying diameter), the chemical composition of the detonating cord is also not limited to a single composition. The detonating cord for use with the device and apparatus herein described can include any cord useful in transferring a shock wave along a string wherein the shock wave can activate a vent device. Additionally, electrical detonators may be used as a means for producing the aforementioned shock wave.

Optionally, the rupturing step may be accomplished by pressure formed by combustion of a material, such as the combustion of a propellant. The combustible material could be situated proximate to the frangible portion of the vent valve wherein the high pressure resulting from the ensuing combustion exerts a sufficient force on the frangible portion to cause it to rupture. Optionally, the region housing the combustible material could be sealed thereby allowing the pressure to build in order to cause the rupture of the frangible portion. Thus instead of an instantaneous micro-second event, the device of the present disclosure could be activated with a combusting compound acting on a millisecond time basis.

In operation, a perforating string having the segment 31 of FIG. 3 is disposed in a wellbore 1 for perforating the wellbore 1. As previously discussed, perforating the wellbore 1 is accomplished by activating a detonation system of the perforating string that in turn detonates the shaped charges 30 associated with the perforating system. Detonation of the shaped charges occurs in response to the shock wave of the detonation system. Activation of the detonation system is accomplished by actuating a firing head. As is known, firing heads are typically included with the perforating string in its uppermost segment and are in electrical or mechanical communication with the detonating cord. Upon activation of the detonating system, the resulting shock wave travels along the length of the detonation system and passes through each segment of the detonating cord 36. The membrane 40 of FIG. 3 is frangably configured to burst in response to exposure of the pressure formed due to the shock wave passing through detonating cord 36. Bursting the membrane 40 removes the fluid flow barrier of the vent valve 34 and in turn provides open fluid communication between the cavity 48 and the topside of the connector sub 28. Thus the same shock wave that causes detonation of the shock waves also allows venting between the cavity 48 and the region ambient to the connector sub 28.

Figure 5:
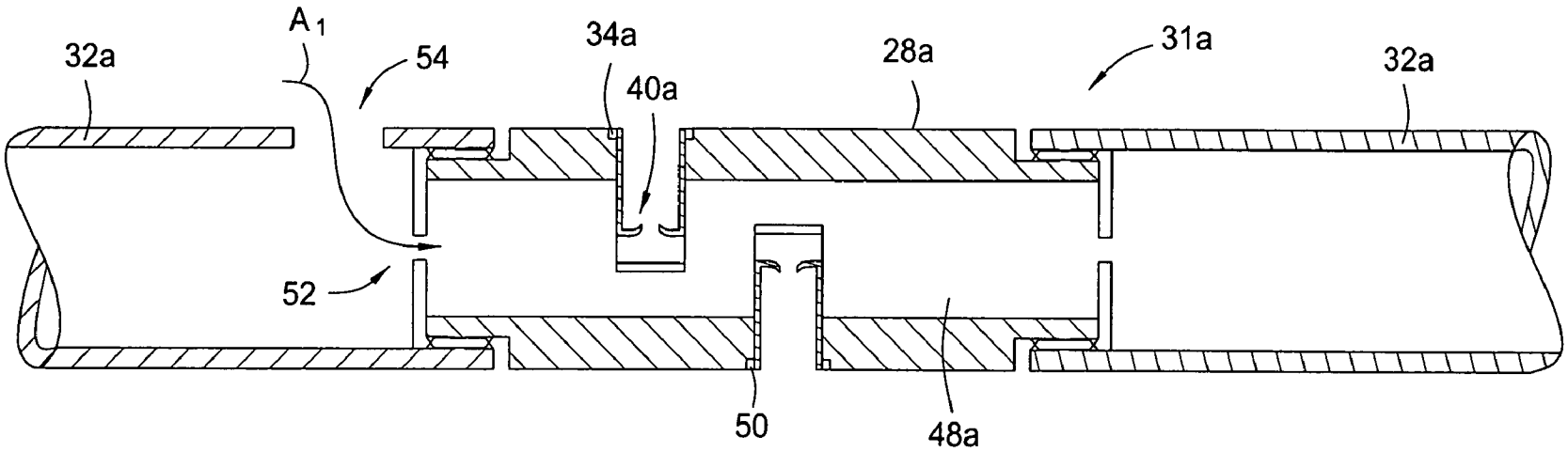
FIG. 5 is a cutaway side view of a segment of a perforating string in accordance with an embodiment of the present disclosure.

FIG. 5 illustrates an embodiment of the perforating string segment 31 a after detonation of the detonating system. Here the discharge of the shaped charge causes either fragmentation or disintegration of its individual elements, and is thus no longer present. Similarly, the detonating cord 36 and transfer charges 37 have been expended during use and are also not present. The resulting detonations of the shaped charges provide an aperture 54 through the wall of the gun body 32*a* and the discharge of the transfer charges 37 similarly produce passages 52 between the connector sub 28*a* and the adjacent gun bodies 32*a* thereby allowing fluid flow from the respective gun bodies 32*a* into the cavity 48*a*. This results in a fluid flow path A1 from outside of the gun bodies 32*a* into the cavity 48*a*. Moreover, the rupture of the membrane 40*a* allows free flow of fluid from the cavity 48*a* to outside of the connector sub 28*a*. Accordingly, if during retrieval of the string segment 31*a* the passages 52 become blocked, the free flow of fluid through the now opened vent valve 34*a* prevents any pressure differential between the cavity 48*a* and ambient to the connector sub 28*a*.

The membrane thickness can be reduced at strategically selected locations along the surface of the membrane 40 to ensure its rupturing in response to an applied shock wave. Optionally, the membrane 40 can include a scored portion 42 along the surface of one of its sides to facilitate bursting the membrane 40. Also alternatively, the coupling member for joining the detonating cord 36 with the vent valve is not limited to the opening 46 but may include a coupling member that is a J-shaped member for coupling the vent valve 34 with the detonating cord 36. Additionally, the coupling member may comprise multiple flexible elements for coupling with the cord 36. It should be pointed out that the generation of a shock wave is not limited to the use of a detonating cord.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the invention described herein is applicable to any shaped charge phasing as well as any density of shaped charge. Moreover, the invention can be utilized with any size of perforating gun. These and other similar modifications will readily suggest themselves to those skilled in the art, and are intended to be encompassed within the spirit of the present invention disclosed herein and the scope of the appended claims.

What is claimed is.

1. A connecting sub comprising:

an annular housing coaxially joined between a first and a second perforating gun;

a recess formed through a lateral side of the housing;

a pressure producing element in the housing; and a non-detonating vent valve provided in the recess having a frangible element in a first configuration encompassing the recess and with pressure from the pressure producing element changeable into a second configuration that does not encompass the recess, so that fluid can communicate through the recess.

2. The connecting sub of claim 1 wherein the pressure producing element is a shock wave producing member.

3. The connecting sub of claim 1 wherein the pressure producing element comprises a combustible propellant.

4. The connecting sub of claim 2 wherein the shock wave producing member comprises a detonating cord.

5. The connecting sub of claim 4, further comprising, a perforating gun attachable to the first end, a first end bulkhead on the first end, a shaped charge detonating cord disposed within the perforating gun, a first transfer charge adjacent the first end bulkhead, the first transfer charge combinable with the connecting sub shock wave producing member and a second transfer charge adjacent a second end bulkhead, the second transfer charge combinable with the perforating gun shock wave producing member.

6. The connecting sub of claim 5, further comprising a second perforating gun attachable to the second end, a shock wave producing member disposed within the second perforating gun, a third transfer charge combinable with the connecting sub shock wave producing member and a fourth transfer charge combinable with the second perforating gun shock wave producing member.

7. The connecting sub of claim 1, further comprising a retaining ring coupled to the housing and to the vent valve.

8. The connecting sub of claim 2 further comprising a coupling member joined to the shock wave producing member.

9. The connecting sub of claim 8, wherein said coupling member is selected from the list consisting of an opening formed to receive the shockwave producing member therethrough, a hook shaped member, and opposing elements formed to receive the shockwave producing member therebetween.

10. A perforating system comprising:

a connecting sub having a housing;

a cavity in the connecting sub sealed from fluid communication with the connecting sub outer surface;

a perforating gun coupled with the connecting sub;

a detonation cord extending through the cavity; and a non-detonating vent valve disposed with said connecting sub, the vent valve comprising, a tubular member extending into the cavity from the connecting sub housing and a membrane in the tubular member adjacent the detonation cord, the membrane having a side exposed to the cavity and an opposite side exposed to outside the connecting sub housing, so that detonating the detonation cord forms a pressure shock wave that ruptures the membrane to allow fluid flow between the cavity and the space outside the connecting sub.

11. The perforating system of claim 10, further comprising a retaining ring coupled to the connecting sub and to the vent valve.

12. The perforating system of claim 10, further comprising a coupling member connecting the detonation cord and the vent valve selected from the list consisting of an opening formed to receive the detonation cord therethrough, a hook shaped member, and opposing elements formed to receive the detonation cord therebetween.

13. A method of perforating in a wellbore comprising:

providing a perforating gun connector having an annular housing, a frangible vent valve extending through a lateral side of the housing, a detonating cord in the housing, and without shaped charge explosives in the gun connector;

coupling a first perforating gun having a shaped charge explosive and associated detonation cord to a first end of the gun connector and coupling a second perforating gun to a second end of the gun connector to form a perforating gun string;

deploying the string into a wellbore;

activating the first perforating gun detonation cord to detonate the shaped charge;

rupturing the vent valve by producing a shock wave in the connector so that fluid communication is provided from the cavity to outside of the connector and from the cavity to within the perforating gun.

14. The method of claim 13, further comprising igniting the connector detonation cord to produce the shock wave in the connector.

15. The method of claim 13 further comprising providing a transfer charge assembly in the perforating gun and the perforating gun connector, the transfer charge assembly activatable by the detonating shock wave to rupture the opposing sides of the connector sub and the perforating gun to thereby provide fluid communication therebetween.

* * * * *